US006768090B2

(12) United States Patent
Kang

(10) Patent No.: US 6,768,090 B2
(45) Date of Patent: Jul. 27, 2004

(54) WALL-MOUNTED TYPE MICROWAVE OVEN

(75) Inventor: Jeon-Hong Kang, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/379,561

(22) Filed: Mar. 6, 2003

(65) Prior Publication Data

US 2004/0104226 A1 Jun. 3, 2004

(30) Foreign Application Priority Data

Nov. 29, 2002 (KR) ..... 10-2002-0075152

(51) Int. Cl.[7] ..... H05B 6/64
(52) U.S. Cl. ..... 219/757; 219/391
(58) Field of Search ..... 219/702, 710, 219/718, 721, 757, 735, 762, 763, 391, 402; 126/21 A, 198, 273 A, 299 R, 299 D; 427/386, 387, 388.1

(56) References Cited

U.S. PATENT DOCUMENTS 4,313,043 A * 1/1982 White et al. ..... 219/757
4,418,261 A * 11/1983 Jailor et al. ..... 219/757
6,211,504 B1 * 4/2001 Lee ..... 219/757

FOREIGN PATENT DOCUMENTS

KR 2000-60555 10/2000

* cited by examiner

*Primary Examiner*—Tu Hoang
(74) *Attorney, Agent, or Firm*—Staas & Halsey LLP

(57) ABSTRACT

A wall-mounted microwave oven having an enhanced blowing capability. The wall-mounted microwave oven includes a cabinet which defines an external appearance of the microwave oven and an exhaust fan unit. An internal duct is provided in the cabinet. An external duct is installed at a predetermined position outside the cabinet so as to communicate with the internal duct. The exhaust fan unit is installed in the external duct and generates a blowing force which discharges contaminated indoor air to the outside of the microwave oven through the internal and external ducts. The wall-mounted microwave oven having such a construction allows a large-capacity exhaust fan and a large-capacity fan motor to be used without increasing the size of the cabinet. Additionally, a capacity of a cooking chamber can be increased without increasing the size of the cabinet.

19 Claims, 6 Drawing Sheets

WALL-MOUNTED TYPE MICROWAVE OVEN

CROSS-REFERENCE TO RELATED APPLICATIONS

This application claims the benefit of Korean Patent Application No. 2002-75152, filed Nov. 29, 2002, in the Korean Intellectual Property Office, the disclosure of which is incorporated herein by reference.

BACKGROUND OF THE INVENTION

1. Field of the Invention

The present invention relates to wall-mounted microwave ovens, and more particularly, to a wall-mounted microwave oven which has an enhanced blowing capability.

2. Description of the Related Art

Generally, a microwave oven is an appliance which cooks food using a magnetron. During a cooking process, a magnetron of the microwave oven generates high-frequency electromagnetic waves. The microwaves penetrate food so as to repeatedly change the molecular arrangement of moisture laden in the food, thus causing the molecules of moisture to vibrate and generate a frictional heat within the food to cook the food. A wall-mounted microwave oven is a microwave oven which is installed above a cooking apparatus, such as a gas oven range in a kitchen space, and collaterally serves as a hood to exhaust contaminated air produced from the cooking apparatus.

FIG. 1 shows a conventional wall-mounted microwave oven which is mounted to a wall of a kitchen space above a gas oven range (not shown). The wall-mounted microwave oven collaterally serves to exhaust gases or odors of food produced from the gas oven range positioned below the wall-mounted microwave oven, in addition to cooking food in a cooking chamber (not shown) therein.

The conventional wall-mounted microwave oven includes a cabinet 1 which defines an external appearance of the microwave oven. The cabinet 1 is partitioned into the cooking chamber and a machine room 2 in which various electrical devices are installed. An exhaust fan unit 3 is provided on an upper portion of the cabinet 1 so as to be positioned above the cooking chamber and the machine room 2. The exhaust fan unit 3 discharges air contaminated with exhaust gases and odors of food, which are produced from the gas oven range, to the outside of the microwave oven.

The exhaust fan unit 3 is mounted to a rear position of the upper portion of the cabinet 1, and includes a fan motor (not shown) and an exhaust fan 4. The fan motor generates a rotating force. The exhaust fan 4 is rotated by the fan motor to generate a blowing force. The exhaust fan unit 3 is operated to upwardly discharge the contaminated indoor air, which passes through the cabinet 1, using the blowing force of the exhaust fan 4.

However, where a large capacity exhaust fan and a large capacity fan motor are used to enhance a blowing capability of the exhaust fan unit 3, the sizes of the exhaust fan and fan motor are inevitably increased. In this case, to maintain the overall size of the cabinet 1, the heights of the cooking chamber and the machine room 2 must be reduced. Accordingly, the capacity of the cooking chamber is undesirably reduced.

SUMMARY OF THE INVENTION

Accordingly, it is an aspect of the present invention to provide a wall-mounted microwave oven which is designed to prevent a capacity of a cooking chamber from being reduced even where a large capacity exhaust fan unit is provided to the microwave oven.

Additional aspects and advantages of the invention will be set forth in part in the description which follows and, in part, will be obvious from the description, or may be learned by practice of the invention.

To achieve the above and for other aspects of the present invention, there is provided a wall-mounted microwave oven which communicates with an exhaust duct of a cooking space, comprising a cabinet which defines an external appearance of the microwave oven, an internal duct which is provided in the cabinet and communicates with the exhaust duct provided outside the cabinet, a heating unit which is provided in the cabinet to cook food, and an exhaust fan unit which is installed in the external duct and generates a blowing force that circulates indoor air through the internal and external ducts.

The microwave oven may further comprise an air inlet port which is provided on a bottom surface of the cabinet and receives the contaminated indoor air provided therebelow, and an air outlet port which is provided on an upper surface of the cabinet and outputs the contaminated indoor air thereabove, wherein the internal duct connects the air inlet port to the air outlet port.

The exhaust fan unit may include a fan motor which generates a rotating force, an exhaust fan which generates the blowing force using the rotating force, and a fan casing which receives the fan motor and the exhaust fan therein.

The fan casing may include two air sucking holes which are provided on both side surfaces of the fan casing and receive the contaminated indoor air discharged from the air outlet port, and an air discharging hole which is provided on one of an upper surface, a front surface, and a rear surface of the fan casing, and discharges the contaminated air to the exhaust duct.

The exhaust fan unit may be installed at a position adjacent to the internal duct, so as to easily transmit the blowing force generated by the exhaust fan unit to the internal duct.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
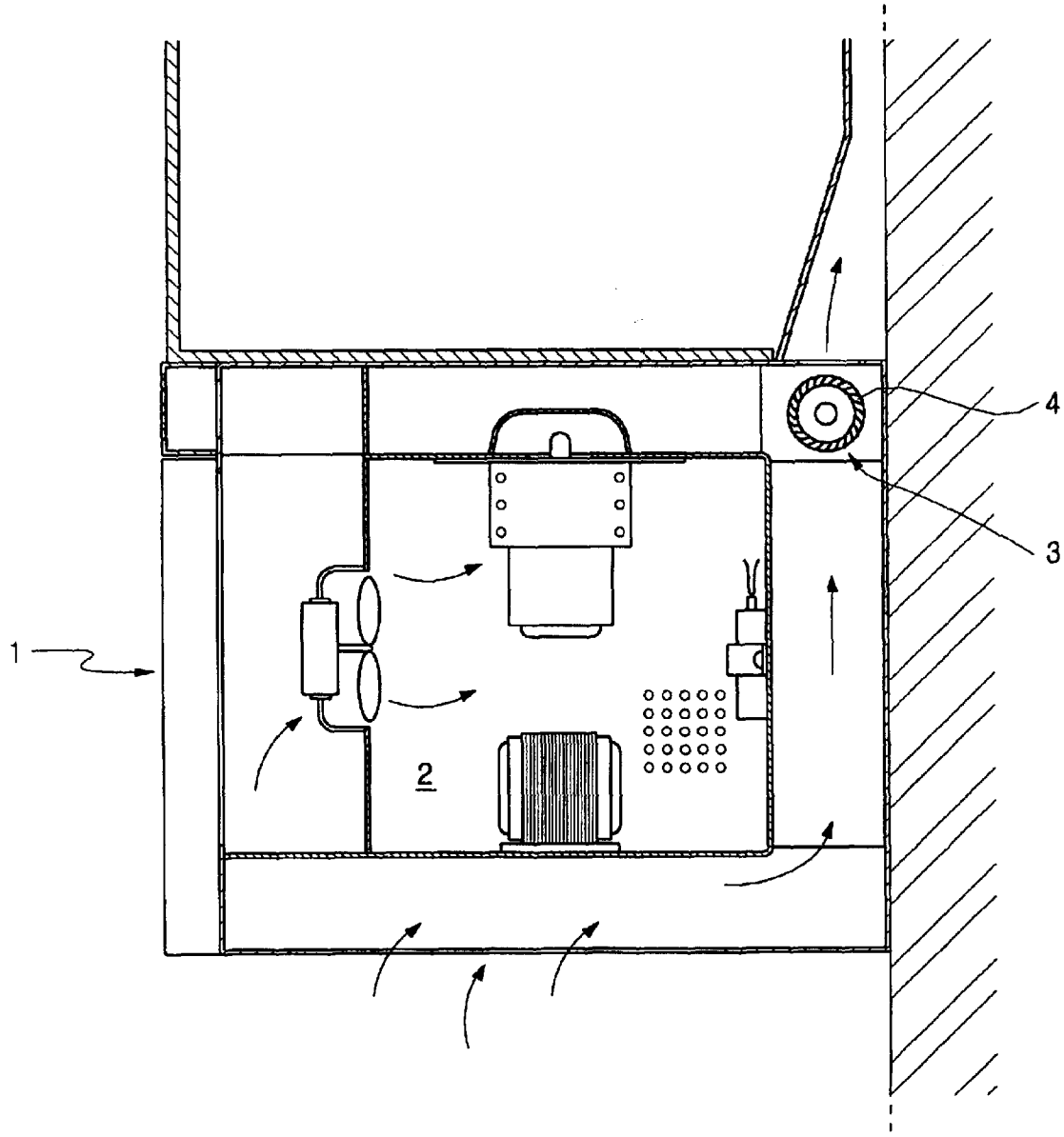
FIG. 1 (PRIOR ART)
FIG. 1 is a side sectional view illustrating a conventional wall-mounted microwave oven.

Reference will now be made in detail to the present preferred embodiments of the present invention, examples of which are illustrated in the accompanying drawings, wherein like reference numerals refer to like elements throughout.

Figure 2:
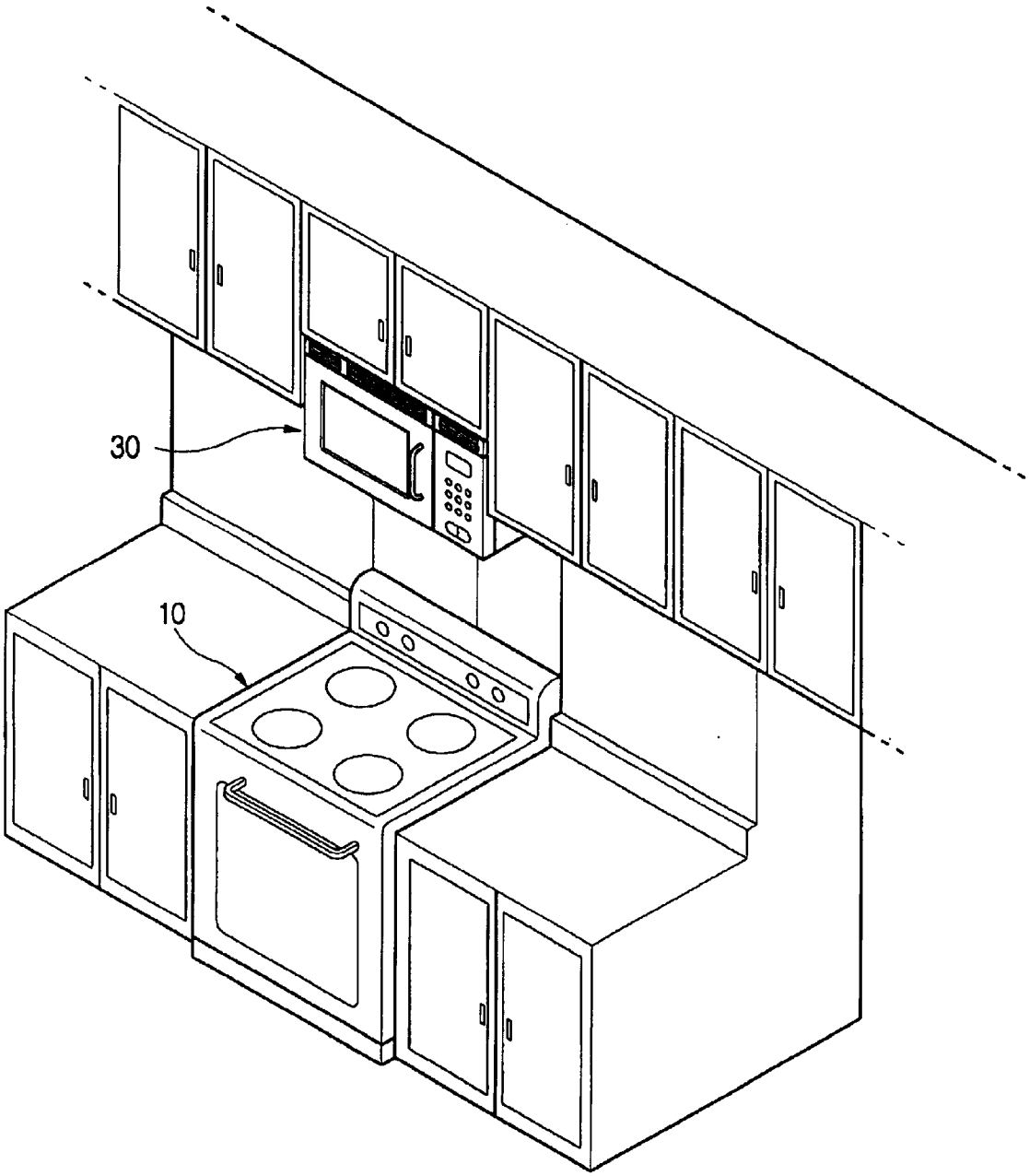
FIG. 2 is a perspective view illustrating a wall-mounted microwave oven according to the present invention, with the microwave oven being installed above an oven range.

FIG. 2 shows a wall-mounted microwave oven according to the present invention which is installed above an oven range 10 in a kitchen space. An external duct 20 (see FIG. 3) is mounted on the microwave oven, and guides exhaust gases and food odors produced from the oven range 10 to, for example, the atmosphere outside the kitchen space.

Figure 3:
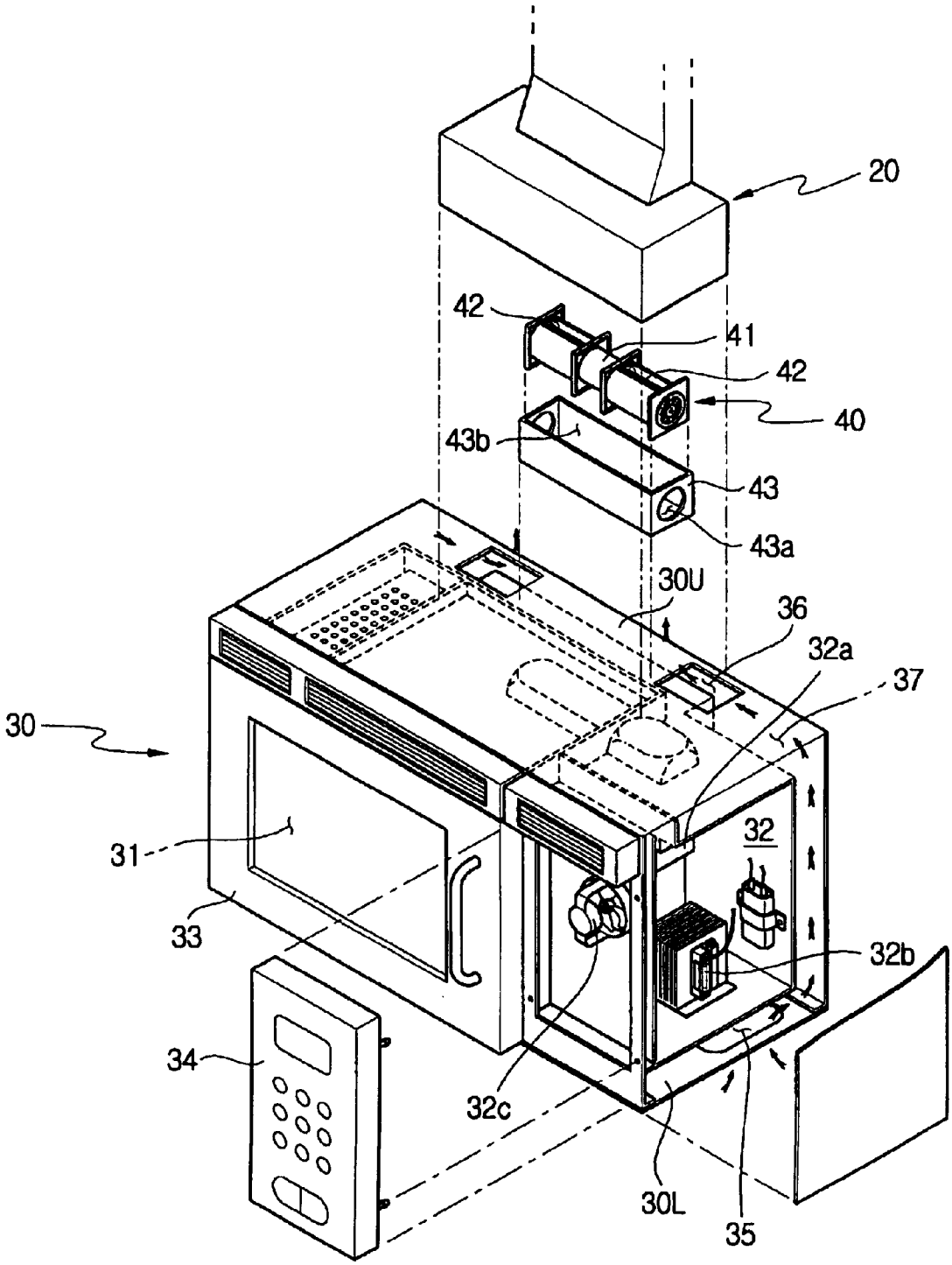
FIG. 3 is an exploded perspective view of a wall-mounted microwave oven according to an embodiment of the present invention.
Figure 4:
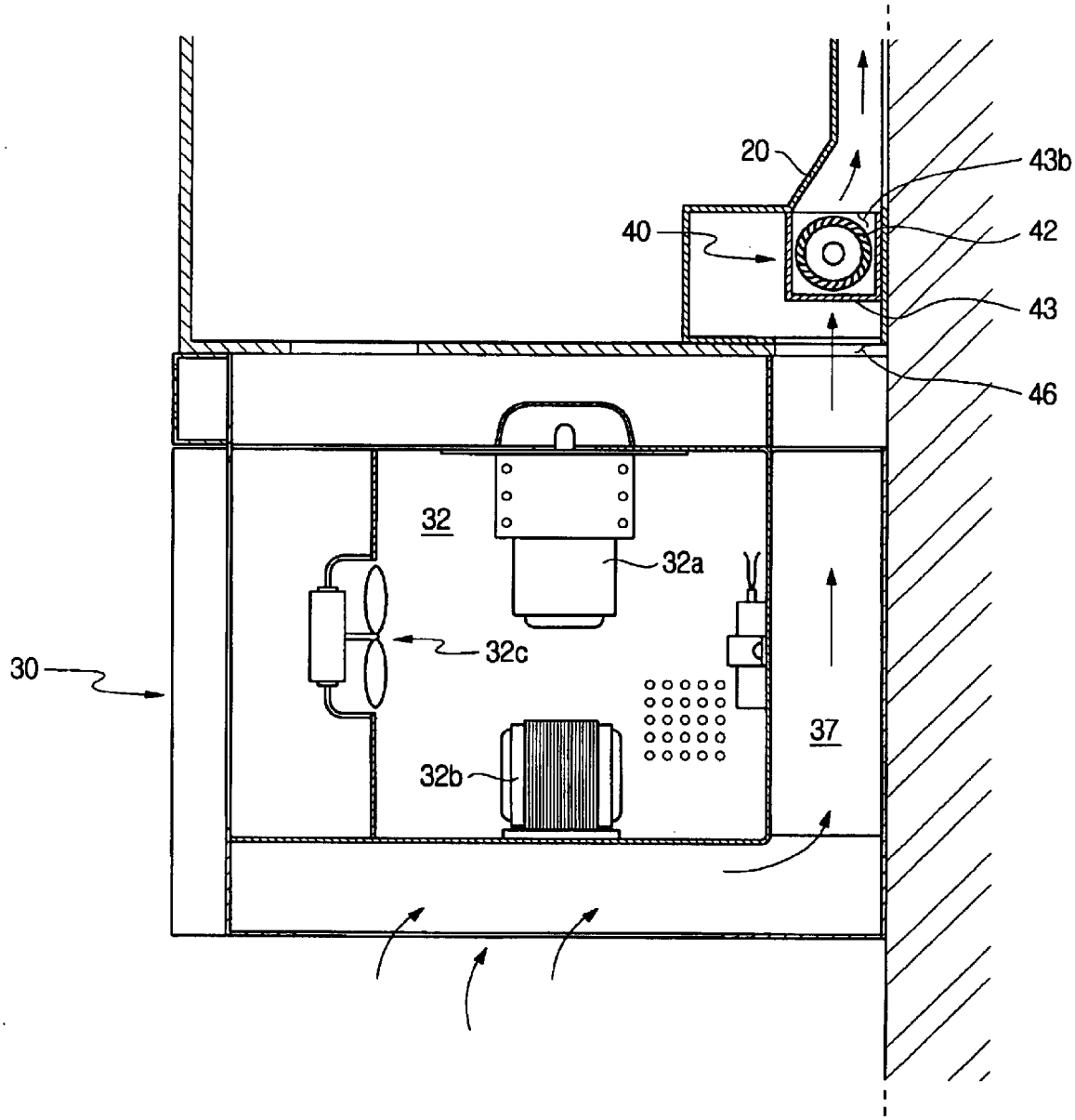
FIG. 4 is a side sectional view illustrating the wall-mounted microwave oven shown in FIG. 3 according to the present invention.

FIGS. 3 and 4 shows a wall-mounted microwave oven according to an embodiment of the present invention. The wall-mounted microwave oven includes a cabinet 30 which defines an external appearance of the microwave oven. The cabinet 30 is partitioned into a cooking chamber 31 and a machine room 32. The cooking chamber 31 receives food to be cooked therein, and the machine room 32 contains various electrical devices to operate the microwave oven.

The cooking chamber 31 is opened at its front. A door 33 is mounted to the cabinet 30 to open or close the cooking chamber 31. A control panel 34 is provided on a front of the machine room 32 and defines a front surface of the cabinet 30 along with the door 33. The control panel 34 functions to control the function of the microwave oven.

Electrical devices including a magnetron 32*a*, a high-voltage transformer 32*b*, and a blowing fan 32*c* are installed in the machine room 32. The magnetron 32*a* irradiates high-frequency electromagnetic waves into the cooking chamber 31. The high-voltage transformer 32*b* applies a high voltage to the magnetron 32*a*. The blowing fan 32*c* functions to cool the electrical devices in the machine room 32.

For example, two air inlet ports 35 are formed on a bottom plate 30L of the cabinet 30 to suck contaminated indoor air into the cabinet 30. The contaminated indoor air is produced from, for example, the oven range 10 which is positioned below the microwave oven, and is laden with exhaust gases and odors of food. Two air outlet ports 36 are formed at predetermined positions on a top plate 30U which defines an upper surface of the cabinet 30 so as to discharge the contaminated indoor air from the cabinet 30.

Internal ducts 37 are provided in the cabinet 30 to guide the contaminated indoor air, which is sucked into the cabinet 30 through the air inlet ports 35, to the air outlet ports 36. One of the internal ducts 37 extends from a lower portion of the cooking cavity 31 to a rear portion thereof while the other internal duct 37 extends from a lower portion of the machine room 32 to a rear portion thereof, thus allowing the contaminated indoor air sucked into the cabinet 30 through the air inlet ports 35 to be guided to the air outlet ports 36.

The contaminated indoor air, which is sucked into the cabinet 30 through the air inlet ports 35, is guided to an external duct 20 through the internal ducts 37 and the air outlet ports 36. Thereafter, the contaminated indoor air is discharged to, for example, the atmosphere outside the kitchen cooking space through the external duct 20.

In this microwave oven, an exhaust fan unit 40 of the microwave oven is provided in the external duct 20, and generates a blowing force to discharge the contaminated indoor air. The exhaust fan unit 40 includes a fan motor 41, two exhaust fans 42, and a fan casing 43. The fan motor 41 generates a rotating force. The exhaust fans 42 are rotated by the fan motor 41 to generate the blowing force. The fan casing 43 receives the fan motor 41 and the exhaust fans 42 therein. The fan motor 41 is installed at a center portion of the fan casing 43. The exhaust fans 42 comprising centrifugal fans are arranged at both sides of the fan motor 41. According to the present invention, the exhaust fan unit 40 is not installed in the cabinet 30, but is installed in the external duct 20. Accordingly, the size of the exhaust fan unit 40 is independent of the sizes of the cabinet 30 and the cooking chamber 31. For example, the sizes of the cabinet 30 and the cooking chamber 31 need not be reduced to accommodate a larger exhaust fun unit to provide for a microwave oven having a greater blowing force/capacity.

Two air sucking holes 43*a* are provided on both side surfaces of the fan casing 43 to suck the contaminated indoor air from the air outlet ports 36. An air discharging hole 43*b* is provided on an upper surface of the fan casing 43 to discharge the contaminated indoor air sucked into the fan casing 43. That is, the exhaust fan unit 40 is designed such that the contaminated indoor air is sucked through the both side surfaces of the fan casing 43 and discharged through the upper surface of the fan casing 43.

In this embodiment, the air discharging hole 43*b* is positioned at the upper surface of the fan casing 43, thus upwardly discharging the contaminated indoor air. However, it is understood that the air discharging hole 43*b* may be positioned differently or provided on a different surface of the fan casing 43 to accommodate the shape and/or position of an external duct.

Figure 5:
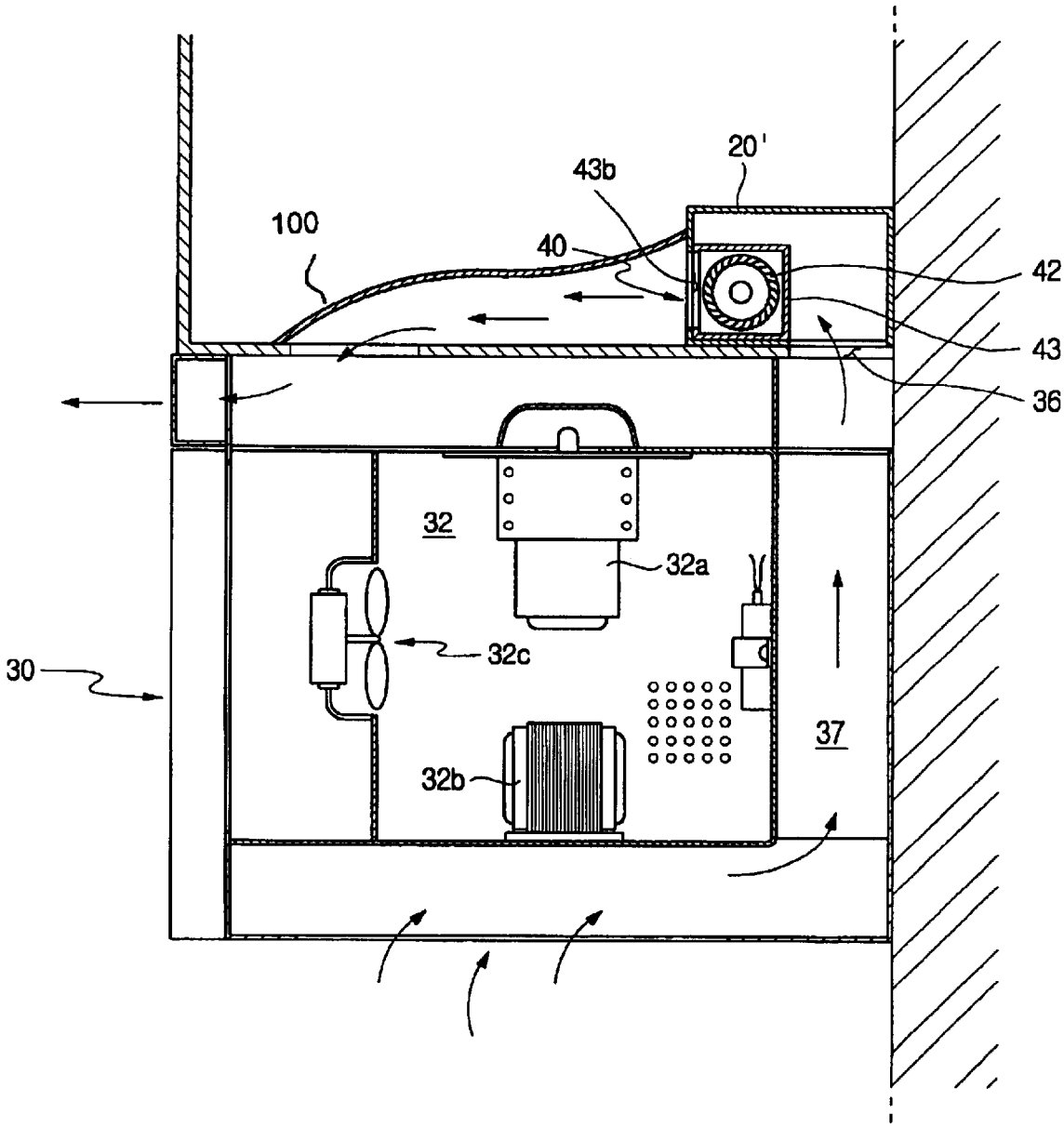
FIG. 5 is a side sectional view illustrating a wall-mounted microwave oven according to another embodiment of the present invention.
Figure 6:
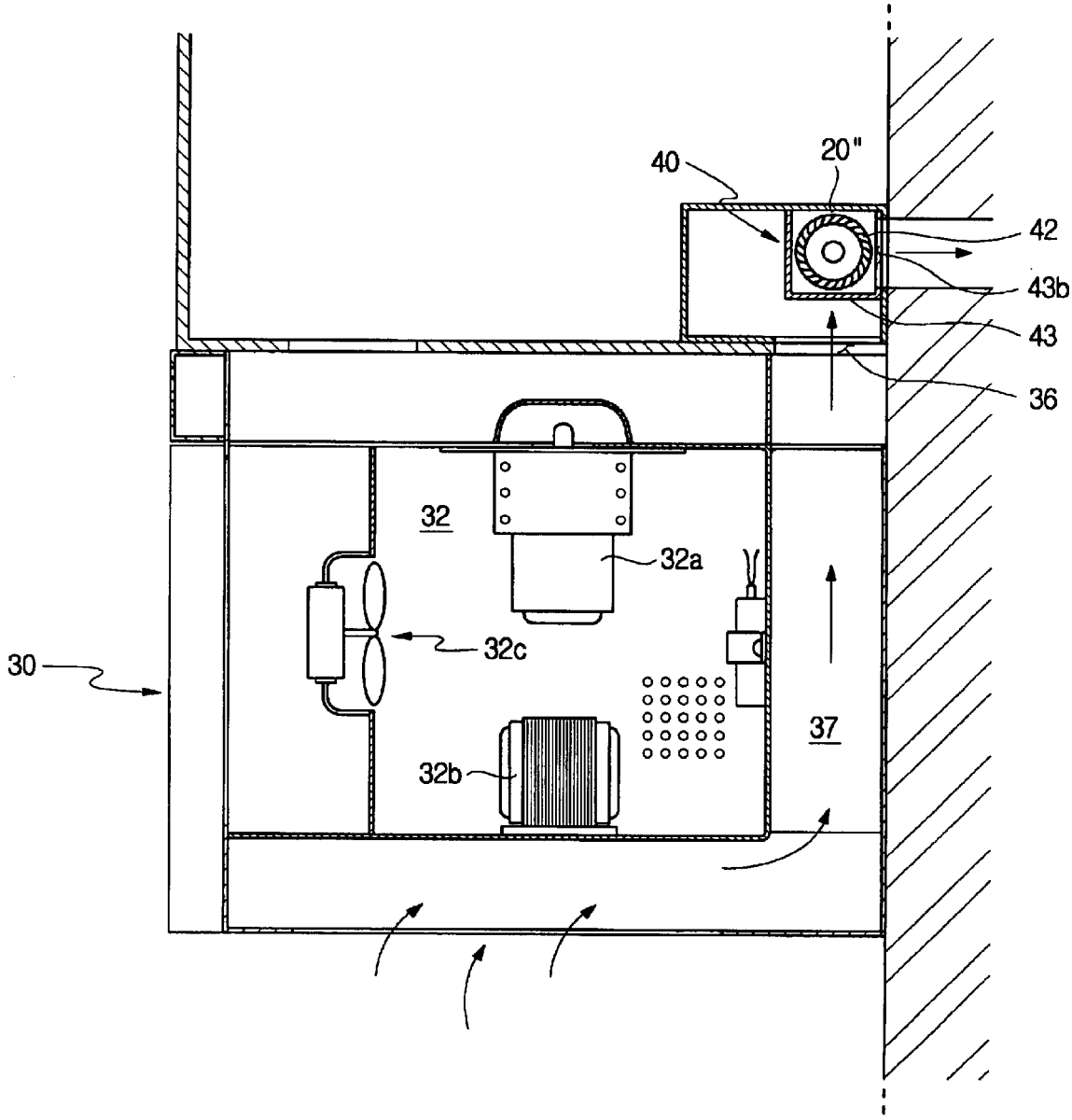
FIG. 6 is a side sectional view illustrating a wall-mounted microwave oven according to yet another embodiment of the present invention.

FIGS. 5 and 6 show microwave ovens according to further embodiments of the present invention, wherein an exhaust fan unit 40 is positioned or rotated according to the shape and/or position of an external duct 20' or 20", respectively, so as to have an air discharging hole 43*b* be positioned at a front surface or a rear surface of a fan casing 43. Accordingly, contaminated indoor air can be discharged forward or rearward with respect to a plane of the microwave oven. For example, FIG. 5 shows that the exhaust fan unit 40 is positioned or rotated to direct the contaminated indoor air toward a front of the microwave oven. In this case, a guide plate 100 can be provided above a cabinet 30 so as to direct the contaminated air from the external duct 20' to an exhaust path (see arrows pointing away from the external duct) provided in the cabinet 30. The exhaust path communicates with the kitchen/cooking space. An air filter (not shown) may be provided in the exhaust path, which filters the contaminated indoor air prior to discharging the air thereof to the kitchen/cooking space.

An operation and effect of the wall-mounted microwave oven according to the present invention will be described in detail with reference to FIGS. 3–6.

Where a power is applied to the exhaust fan unit 40, the fan motor 41 is rotated to operate the exhaust fans 42. At this time, a blowing force is generated. Due to the blowing force, contaminated indoor air sequentially passes through the air inlet ports 35, the internal ducts 37, and the air outlet ports 36, which are provided in the cabinet 30, and is then discharged upward. Subsequently, the contaminated indoor air is sucked into the fan casing 43 through the air sucking holes 43*a* which are provided on the both side surfaces of the fan casing 43. Next, the contaminated indoor air passes through the air discharging hole 43b which is, for example, provided at the upper surface of the fan casing 43 (see embodiment shown in FIG. 4), and flows along the external duct 20 to be discharged to, for example, the atmosphere outside the kitchen/cooking space.

Since the exhaust fan unit 40 is not installed in the cabinet 30, but rather installed in the external duct 20, a large-capacity fan motor 41 and large-capacity exhaust fans 42 may be used in the wall-mounted microwave oven without decreasing a capacity of the cooking chamber 31 to accommodate the larger fan motor 41 and exhaust fans 42. Rather, the capacity of the cooking chamber 31 can be increased, as compared to a conventional microwave oven having an exhaust fan unit provided in a cabinet having the same dimension as the cabinet 30 of the present invention.

As described above, the present invention provides a wall-mounted microwave oven having an exhaust fan unit which is not installed in a cabinet, but rather, installed in an external duct. Accordingly, a large capacity exhaust fan and a large capacity fan motor may be utilized by the present wall-mounted microwave oven regardless of the sizes of the cabinet and a cooking chamber. In fact, the capacity of the cooking chamber can be increased by providing the exhaust fan unit of the microwave oven to be placed inside the external duct.

In the present invention, the exhaust fan unit may be rotated so as to have an air discharging hole face different directions with respect to a plane of the microwave oven. Therefore, a discharging direction of cooking air can be easily changed accordingly to the shape and/or position of the external duct.

Although a few preferred embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A wall-mounted microwave oven which communicates with an exhaust duct of a cooking space, comprising:

a cabinet which defines an external appearance of the microwave oven;

an internal duct which is provided in the cabinet and communicates with the exhaust duct provided outside the cabinet;

a heating unit which is provided in the cabinet to cook food; and an exhaust fan unit which is installed in an external duct disposed outside of the cabinet, and generates a blowing force that circulates contaminated indoor air through the internal and external ducts.

2. The wall-mounted microwave oven as set forth in claim 1, further comprising:

an air inlet port which is provided on a bottom surface of the cabinet and receives the contaminated indoor air provided therebelow; and an air outlet port which is provided on an upper surface of the cabinet and outputs the contaminated indoor air thereabove, wherein the internal duct connects the air inlet port to the air outlet port.

3. The wall-mounted microwave oven as set forth in claim 1, wherein the exhaust fan unit comprises:

a fan motor which generates a rotating force;

an exhaust fan which generates the blowing force using the rotating force; and a fan casing which receives the fan motor and the exhaust fan therein.

4. The wall-mounted microwave oven as set forth in claim 3, wherein the fan casing includes:

two air sucking holes which are provided on both side surfaces of the fan casing and receive the contaminated indoor air discharged from the air outlet port; and an air discharging hole which is provided on one of an upper surface, a front surface, and a rear surface of the fan casing, and discharges the contaminated indoor air to the exhaust duct.

5. The wall-mounted microwave oven as set forth in claim 1, wherein the exhaust fan unit is installed at a position adjacent to the internal duct, so as to transmit the blowing force generated by the exhaust fan unit to the internal duct.

6. The wall-mounted microwave oven as set forth in claim 1, wherein the exhaust fan unit discharges the contaminated indoor air generated below the cabinet to the exhaust duct.

7. The wall-mounted microwave oven as set forth in claim 1, wherein the exhaust duct outputs the contaminated indoor air to one of the cooking space, through an exhaust path of the cabinet, and the outside of the cooking space.

8. The wall-mounted microwave oven as set forth in claim 7, further comprising a guide plate which is provided above the cabinet and directs the contaminated indoor air exhausted from the exhaust duct to the exhaust path of the cabinet, wherein the exhaust path communicates with the cooking space.

9. The wall-mounted microwave oven as set forth in claim 8, further comprising an air filter unit which is provided in the exhaust path and filters the contaminated indoor air prior to discharging thereof to the cooking space.

10. The wall-mounted microwave oven as set forth in claim 2, wherein the air outlet port communicates with the exhaust fan unit.

11. The wall-mounted microwave oven as set forth in claim 1, wherein:

the exhaust fan unit includes an air discharging hole which discharges the contaminated indoor air to the exhaust duct, and the air discharging hole is provided to one of an upper surface, a front surface, a side surface, and a rear surface of the exhaust fan unit, so as to direct the contaminated air into a predetermined direction.

12. The wall-mounted microwave oven as set forth in claim 1, wherein the exhaust fan unit is rotatable so as to direct the contaminated air into a predetermined direction with respect to the microwave oven.

13. The wall-mounted microwave oven as set forth in claim 1, wherein the heating unit includes a magnetron which generates microwaves to cook the food.

14. A wall-mountable oven which communicates with an exhaust duct of a cooking space, comprising:

a cabinet which defines an external appearance of the microwave oven;

a heating unit which is provided in the cabinet to cook food;

an internal duct which is provided in the cabinet and communicates with the exhaust duct provided outside the cabinet; and an exhaust fan unit which is installed in an external duct disposed outside of the cabinet, draws in cooking air disposed below the cabinet and discharges the cooking air to the exhaust duct through the internal duct.

15. The wall-mountable oven as set forth in claim 14, wherein the exhaust duct outputs the cooking air to one of the cooking space, through an exhaust path of the cabinet, and the outside of the cooking space.

16. The wall-mountable oven as set forth in claim 14, wherein:

the exhaust fan unit includes an air discharging hole which discharges the cooking air to the exhaust duct, and the air discharging hole is provided at one of an upper surface, a front surface, a side surface, and a rear surface of the exhaust fan unit, so as to direct the contaminated air into a predetermined direction.

17. The wall-mountable oven as set forth in claim 14, wherein the exhaust fan unit is rotatable so as to direct the cooking air into a predetermined direction with respect to the microwave oven.

18. The wall-mountable oven as set forth in claim 14, wherein the heating unit includes a magnetron which generates microwaves to cook the food.

19. The wall-mountable oven as set forth in claim 18, wherein the wall-mountable oven is a wall-mountable microwave oven.

* * * * *